United States Patent [19]

Selander et al.

[11] 4,012,279

[45] Mar. 15, 1977

[54] PROCESS OF PRODUCING PULP, FOR MANUFACTURE OF FIBERBOARD, IN A CLOSED BACKWATER SYSTEM

[75] Inventors: Stig Selander; Karl Cederquist, both of Stockholm, Sweden

[73] Assignee: Stig Selander, Stockholm, Sweden

[22] Filed: Dec. 30, 1974

[21] Appl. No.: 537,470

[30] Foreign Application Priority Data

Dec. 28, 1973 Sweden ..... 7317565

[52] U.S. Cl. ..... 162/13; 162/18; 162/23; 162/47; 162/68; 162/190; 162/225; 241/28

[51] Int. Cl.[2] ..... D21C 3/24; D21F 11/00

[58] Field of Search ..... 162/23, 26, 187, 190, 162/264, 13, 68, 100, 56, 47, 28, 189, 225, 224, 206, 17, 18; 241/28

[56] References Cited

UNITED STATES PATENTS

| | | | |
|---|---|---|---|
| 865,168 | 9/1907 | Dohan | 162/264 X |
| 1,670,874 | 5/1928 | Bankus et al. | 162/264 |
| 1,949,534 | 3/1934 | Doyle | 162/187 |
| 1,983,572 | 12/1934 | Statham et al. | 162/190 X |
| 2,008,892 | 7/1935 | Asplund | 162/23 X |
| 2,610,119 | 9/1952 | Magnuson | 162/23 |
| 3,446,697 | 5/1969 | Alvang et al. | 162/23 X |
| 3,821,073 | 6/1974 | Eriksson | 162/264 X |
| 3,907,630 | 9/1975 | Selander | 162/13 |

OTHER PUBLICATIONS

Technical Association Papers, Series VI, June 1923, pp. 91–93, Brown.

*Primary Examiner*—Robert L. Lindsay, Jr.
*Assistant Examiner*—Arthur L. Corbin
*Attorney, Agent, or Firm*—Eric Y. Munson

[57] ABSTRACT

Lignocellulose fiber containing chips, preheated with steam liberated from a previous chip defibration, are dewatered and then defibrated in an atmosphere of saturated steam and in the presence of backwater and suspended in backwater to form a pulp suspension whereafter wet sheets are formed from the pulp suspension, water is mechanically removed from the wet sheets and recycled as backwater to be supplied simultaneously, with dewatered chips, to the defibration step and to form a new pulp suspension and said wet sheets are dried.

11 Claims, 1 Drawing Figure

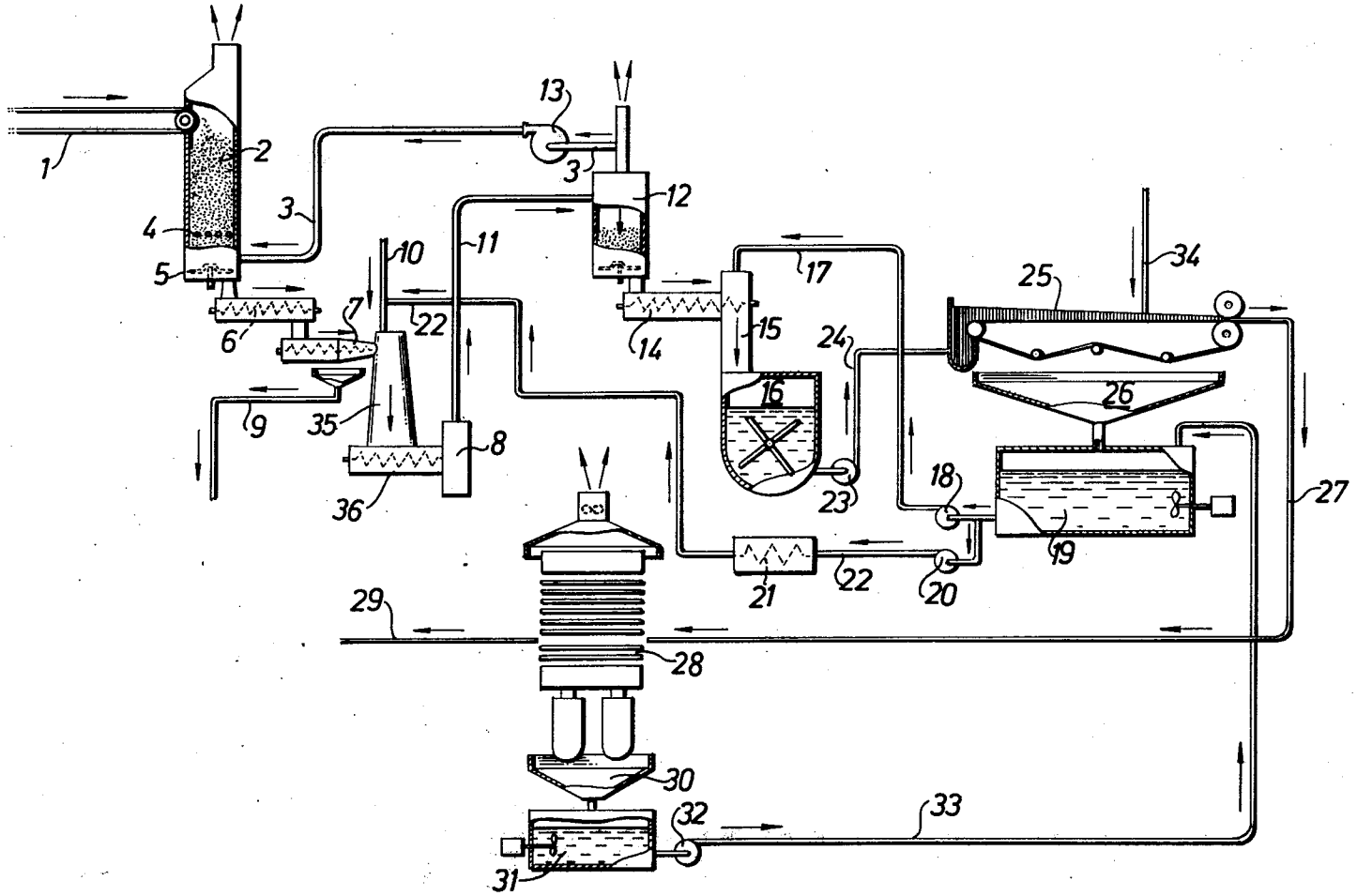
1
2
3
4
5
6
7
8
9
10
11
12
13
14
15
16
17
18
19
20
21
22
23
24
25
26
27
28
29
30
31
32
33
34
35
36

PROCESS OF PRODUCING PULP, FOR MANUFACTURE OF FIBERBOARD, IN A CLOSED BACKWATER SYSTEM

FIELD OF THE INVENTION

This invention relates to a process of producing pulp having a high dry content for manufacture of fiberboard according to the wet method in a closed backwater system.

BACKGROUND OF THE INVENTION

As disclosed in the copending U.S. patent applications Ser. Nos. 418,005, filed Nov. 21, 1973 now Pat. No. 3,907,630 now dated 4/23/75, and 504,739, filed Sept. 10, 1974 now Pat. No. 3,977,540 date 6/29/76, respectively, the essential condition in the manufacture of fiberboard according to the wet method, which renders possible completely to close the backwater system and to produce the fiber suspension with backwater, i.e., white water only, is that the fibrous material fed into the process flow must have a content of dry substance which is substantially higher than that of the wet sheet prior to the final drying thereof by evaporation of water. Depending on the density which is to be imparted to the fiberboard, the final drying can be effected under simultaneous mechanical compression or without such compression.

In the manufacture of hardboard, for example the wet sheet is subjected to so high a mechanical pressure that the compressed wet sheet acquires a dry content of 50 to 55 percent before the final drying operation is carried out. In order to obtain this dry content of the compressed sheet, the fiber material discharged from a disintegrating or grinding apparatus, hereinafter referred to by the name "defibrator," must have a dry substance content of at least 50 to 55 percent. Normally, the content must be kept between 55 and 70 percent in order to permit a certain quantity of water to enter the process without causing any danger of discharge of backwater into the drainage system. When manufacturing insulation fiberboard, in which case the dry content of the wet sheet amounts to between 40 and 50 percent, a dry content of the discharged fiber material of between 50 and 55 percent is sufficient.

Utilization of water as sealing agent at the places of passage of the shaft in the defibrator must be limited or completely eliminated, e.g., by utilization of steam.

Fiber material suited for the process according to the invention may be produced from any kind of lignocellulose-containing fibrous material, which has been disintegrated in a suitable manner, e.g., wood in the form of chips or sawdust, or straw, or bagasse etc., which hereinafter is generally referred to as "chips".

The defibration is assumed to be effected in a steam atmosphere at atmospheric pressure or increased pressure up to 15 atmosphere excess pressure, corresponding to a temperature range between 100° and 200° C.

In the defibration of wood chips which have been thoroughly heated in saturated steam, usually about 250 KWh are consumed per ton chips, calculated as bone dry, if the defibration is performed at a temperature 160° and 170° C. At lower temperatures, an increased consumption of energy must be calculated with. The supplied electrical energy is converted almost quantitively into thermal energy in the form of steam. The heat production is concentrated in the grinding zone, and in order to avoid local overheating of the fiber material, a sufficient amount of water must be present, and a grinding produce concentration in the grinding zone, which is in excess of 60 percent is not advisable.

Assuming that the defibration is effected at a temperature of 165° C and that the chips have a dry content of 50 percent and a temperature of 5° C when introduced into the defibrator, the concentration of the grinding produce within the defibrator will be about 47 percent and the concentration of the pulp after blowing it out to atmospheric pressure will be about 51 percent, provided the chips have been heated up to 165° C by means of steam and the defibrating energy amounts to 240 KWh per ton bone dry substance and that no dilution has occurred through sealing water or moisture entering the steam. If the dry content of the chips is 55 percent, the pulp concentration under conditions otherwise the same will be 54 and 57.5 percent for the grinding produce and the discharged pulp, respectively. If the dry content of the chips is lower, e.g., 45 percent, the concentration values will be, respectively, 42 and 45.5 percent. Normally, however, a dilution of the pulp will occur due to entering water, and in practice one must calculate with lower pulp concentrations than those stated here.

The fact that the pulp concentration subsequent to defibration, nevertheless becomes so high, in spite of water added partly as moisture in the chips and partly as condensed steam, is due to the generation of heat in the grinding zone, whereby a quantity of water corresponding to the heat generation is evaporated.

In the manufacture of insulation fiberboard, in which case the wet sheet prior to the drying has a dry content of between 40 and 50 percent one should, under favorable conditions, be able to defibrate chips having a dry content of 50 percent.

SUMMARY OF THE INVENTION

According to the present invention when, the chips have too low a dry content prior to the defibrating step, they are freed from a portion of the water by mechanical compression to such a degree that the dry content of the chips will exceed that of the board blanks at the commencement of the final drying step. To this end, the dry content must be increased to at least 50 percent and most suitably to a range from 55 to 70 percent. However, with this high dry content, the chips would be exposed to the risk of deleterious superheating or sticking and become burned in the grinding zone. In order to avoid this risk and also to eliminate the need of fresh water, the invention purports to supply backwater to the grinding produce during the defibrating step.

As an additional measure to prevent dilution of supplied backwater by steam condensed in the defibrator the backwater should be preheated to a temperature of 100° C or higher. In this manner, even some evaporation of backwater can be obtained in the defibrating step, and the quantity of backwater discharged with the pulp becomes less than the quantity of supplied backwater.

An indirect preheating of backwater to a high temperature of, e.g., 200° C may, however, create incrustation problems, and in practice the preheating should not exceed 170° C.

By utilizing the steam set free when the pulp is discharged from the defibrator for heating and steaming of the chips thoroughly at 100° C, the discharge water is facilitated when the chips are dewatered by mechanical compression, which results from the fact that a higher volumetric weight is attained without increased compressive pressure. For example, in order to increase the volumetric weight of some certain type of chips from 0.2 to 8.7 by compression, a pressure of 150 kgs per $cm^2$ must be applied to non-steamed chips, whereas a pressure of 70 kgs per $cm^2$ is sufficient for steamed chips.

By the preheating of the chips, a considerable saving of live steam also is obtained where the defibration is effected under pressure and the compressed chips having a temperature of between 90° and 100° C are fed directly into the defibrator. At least half of live steam supplied to the defibrating apparatus can be saved in this manner.

As an example it may be mentioned that, when the chips after the compression have a dry content of 50 percent and a temperature of 100° C when fed into the defibrator, which is assumed to be operated at a temperature of 165° C, the discharged pulp will have a dry content of 57–58 percent, provided that no additional water enters. If, under the otherwise same conditions, the dry content of the chips is 55 percent, the dry content of the pulp will amount to 64–65 percent. It has been shown that such a concentration of the grinding produce has been reached in the defibrator that backwater according to the invention must be supplied to adjust the concentration.

During the steaming of the chips, varying quantities of steam are condensed out onto and into the chips which increases the water content of the chips and thus increases the importance of squeezing out water. If the chips have a dry content of 50 percent, for example, this content during the steaming is reduced to 47–48 percent, and 410 kgs water must be squeezed out from each ton of chips, calculated as bone dry, in order to reach a dry content of 55 percent, for example, which result actually is obtainable, provided that hot steamed chips are compressed.

Of the quantity of liquid squeezed out in this manner, 250 kgs are steam condensate and 160 kgs wood moisture. If, to the contrary, water is squeezed out from the chips prior to preheating to such a quantity, for example, that the dry content of the chips is increased from 50 to 60 percent and the chips thereupon are preheated with steam to 100° C, the chips will have a dry content of about 55 percent, which in the most favorable circumstances can result in a pulp having a final dry content of 64–65 percent. In this case, the quantity of squeezed-out wood water will be about 330 kgs per ton chips, calculated as bone dry, without regard to content of steam condensate. Partial removal of the wood moisture prior to the preheating of the chips with steam may in some cases be advantageous, because the squeezed-out water due, firstly to its low quantity and secondly to its low content of impurities, is well suited to be used again or neutralized. The removal of water prior to the preheating step is especially important when washing of the chips is included in the process. In such a case, substantial quantities of water in addition to the moisture inherent to the wood accompany the chips and reach values in the range between 250 and 350 kgs of water per ton of chips. It is then advisable to centrifuge or compress the chips to remove excess water, before the chips are preheated and compressed again in preparation for feeding them into the defibrator.

When washing very dry chips having, e.g., a dry content of from 55 to 65 percent, only the adhering water need to be removed simply by centrifuging.

Depending on the applicable conditions, the dry content of the chips can be adjusted in various ways to a suitable level between 50 and 70 percent and to a temperature of the chips of 100° C prior to feeding them into the defibrator. Thus, excess water may be removed from the chips by centrifuging or compression prior to preheating the chips and feeding them into the defibrator, or excess water may be removed from the chips in such a manner that water is partially removed prior to, and partially after, the preheating, or water may be removed merely by squeezing it out after the preheating step prior to, or in conjunction with, the feeding of the chips into the difibrator.

Of course, water can be removed also by predrying the chips by means of hot air, hot combustion gases or superheated steam as mentioned in copending application Ser. No. 418,005, now U.S. Pat. No. 3,907,630. It will become more favorable from the view-point of heat economy to dry the incoming chips than to dry the pulp upon discharge. If washing of the chips is included in the process, the chips must be freed of adhering water before they are subjected to drying. If the intention is to dry the preheated chips, such drying must be made with superheated steam so that the temperature of the chips can be maintained during the feeding thereof into the defibrator.

Chips, which have a dry content of 60 percent or higher, can be preheated directly with steam and be fed into the defibrator. However, it is generally more advantageous to adjust a dry content by compression after the preheating step so that a dry content of 60 percent at a chip temperature of 100° C is ensured. When chips with said dry content and temperature are defibrated at 165° C, 200 kgs of backwater of 130° C and 120 kgs sealing water of 65° C can be fed into the difibrator per 1 ton of chips and thereby a final product having a dry content of 67–68 percent disregarding added backwater, can be obtained with a concentration of the grinding produce in the defibrator amounting to about 55 percent.

It is important that the chips are thoroughly heated and effectively steamed, since thereby the dewatering or drying step is rendered easier. The preheating of the chips is effected in the simplest manner by conducting steam directly through an appropriately thick layer of chips. In this connection, the steam must overcome a certain counterpressure, which, however, need not exceed some meters water column. If the defibration is effected under pressure, the pulp is blown out to atmospheric pressure through a cyclone. If the steam is to be utilized for preheating chips, it must be introduced by force sufficient to overcome the resistance in the layer of chips. Then the cyclone can either work under a lesser counterpressure or the steam can be propelled by means of a fan or compressor through the layer of chips.

In order to illustrate the importance of high dry substance content of the produced pulp it should be mentioned that when operating with pulp having a dry content of 60 percent, about 300 kgs of fresh water per ton bone-dry material can be supplied to form the suspension without causing any excess of backwater to be produced. If the pulp has a dry content of 65 percent about 450 kgs of water can be added.

When defibrating chips in an atmosphere of steam, a portion of the wood substance is dissolved by hydrolysis. The quantity of dissolved substance depends mainly on the temperature and can be limited by carrying out the defibration at moderate temperatures. However, it is possible further to limit the dissolution by increasing the pH-value of the grinding produce during the defibration which suitably can be made by adding basic-reacting substances, e.g., oxides, hydrates or carbonates or calcium to the chips when these are being fed into the defibrator. The quantities vary with the kinds of wood, but are normally small, such as from 1 to 2 kgs CaO per ton grinding produce calculated as bone dry.

In completely closed backwater systems in connection with manufacture of hard fiberboard, for example, the concentration of wood substance dissolved in the backwater will be of the same order of magnitude as the dissolution, calculated by percentage of the wood. Therefore, it is of importance to counteract as much as possible dissolution or organic substance and in this way to obtain a backwater having a so low content of soluble substances as possible.

The water which possibly escapes when the chips are compressed can at least partly be used for the washing of chips, as spraying water in the board-forming step, etc., or as sealing water.

SUMMARY OF ADVANTAGES OF THE INVENTION

In the manufacture of fiberboard according to the wet method with a wholly closed backwater system, the present process gives the following advantages:

1. No drying of pulp after defibration is necessary.
2. Drying of chips can be dispensed with.
3. Steam set free in the discharge of the pulp is utilized effectively for thorough heating of the chips to 100° C.
4. Excess water in the chips is removed easily without using additional heat.
5. If the defibrator is operated under pressure, a substantial saving of live steam applied to the defibrator, is obtained. In many cases about 50 percent are saved.
6. Pulp having a dry content up to between 65 and 70 percent can be produced without risk of overheating of the fibers in the grinding zone. In this connection, the dry content of the pulp is calculated without regard to the supplied backwater.
7. Reduced costs of investment and operation in comparison with drying of pulp or chips by using steam or various kinds of fuel.

THE DRAWING

A preferred embodiment of the invention is described with reference to the attached drawing which shows diagrammatically a flow sheet for the process. It illustrates the circulation system for backwater and the pretreatment of wood chips by steaming and subsequent dewatering by mechanical squeezing in connection with feeding of the chips into the defibrator.

DETAILED DESCRIPTION OF THE DRAWING

As will be seen from the drawing, wood chips are conducted on conveyor 1 to tower 2 where they are heated with steam drawn off from cyclone 12 and propelled by fan 13 through the pipe 3 to the tower 2. The hot chips are advanced via a grate 4 and discharge means 5 to conductor 6 which carries the chips to screw press 7 within which the dry content of the chips is adjusted to a suitable value, such as 50 percent, by squeezing out water, whereupon the chips are fed through a preheater 35 and via a screw conveyor 36 into a defibrator 8 operating at a temperature of 165° C and under a steam pressure of 7 atmospheres excess pressure. Water possibly squeezed out from the wood chips is drained off through pipe 9 to a washing station for chips, etc. Live steam is supplied to the defibrator through pipe 10, and at the same time a predetermined quantity of backwater is supplied to the defibrator from storage tank 19 by means of pump 20 and pipe 22, said backwater previously having passed through heat exchanger 21 to be heated therein to 130° C. The pulp completely disintegrated in the defibrator 8 is blown out through duct 11 to cyclone 12, from which liberated steam is conducted to the tower 2. The pulp separated off in the cyclone 12 is conducted through screw conveyor 14 and via a vertical down chute 15 to pulp chest 16 to which backwater simultaneously is fed from the storage tank 19 by means of pump 18 through pipe 17. The finished pulp suspension is pumped by pump 23 through duct 24 onto the wire of a forming machine 25. The backwater drained off from said machine is collected in the funnel 26 wherefrom it flows down into the storage tank 19. The wet sheet 27 is conveyed to hot press 28 and dewatered mechanically to a dry content of 50 percent and finally by simultaneously applying heat and pressure dried to end product 29. Squeezed-out backwater is collected in the funnel 30 and drained into tank 31 from which the backwater by pump 32 is propelled through pipe 33 to the tank 19. Through pipe 34 limited quantities of fresh water or squeezed-out water are supplied as spray water to the forming machine 25.

What is claimed is:

1. In a process for manufacturing fiberboard according to the wet method and with a closed backwater system which includes in sequence the steps of: defibrating lignocellulose fiber containing chips within a disintegrating apparatus in a vapor phase of saturated steam of superatmospheric pressure, suspending the defibrated material discharged from the defibrating step in backwater serving as propellant liquid to form a pulp suspension, forming wet sheets from the pulp suspension, mechanically separating off water from the wet sheets and recycling the water as backwater to form a new pulp suspension and drying the sheets of evaporation of water, the improvement comprising the steps of liberating steam from the defibrated material and preheating the chips at atmospheric pressure with said liberated steam, then de-watering the steam-heated chips to a dry content of at least 50 percent, thereafter feeding the thus heated and de-watered chips to the defibrating step and simultaneously supplying backwater separated from the wet sheets to the defibration step for minimizing overheating of the fiber material.

2. An improved process as claimed in claim 1, wherein the preheated chips are de-watered by mechanically compressing the chips.

3. An improved process as claimed in claim 2, including the further step of partially drying the compressed chips before they are fed into the defibrating step.

4. An improved process as claimed in claim 1, wherein the chips are preheated to a temperature in the range from 90° to 100° C.

5. An improved process as claimed in claim 1, further including the step of discharging the steam liberated from the defibrated material discharged in the defibrating step under a steam pressure sufficient to force it through a layer of chips to be preheated.

6. In a process for manufacturing fiberboard according to the wet method and with a closed backwater system which includes in sequence the steps of: defibrating lignocellulose fiber containing chips within a disintegrating apparatus in an atmosphere or saturated steam, suspending the defibrated material discharged from the defibrating step in backwater serving as propellant liquid to form a pulp suspension, forming wet sheets from the pulp suspension, mechanically separating off water from the wet sheets and recycling the water as backwater to form a new pulp suspension and drying the sheets by evaporation of water, the improvement comprising the steps of liberating steam from the defibrated material and preheating the chips with said steam to a temperature in the range of 90° to 100° C, then de-watering the steam-heated chips to a dry content of at least 50 percent, thereafter feeding the thus heated and de-watered chips to the defibrating step and simultaneously supplying backwater separated from the wet sheets to the defibration step for minimizing overheating of the fiber material.

7. An improved process according to claim 6, further including the step of blowing at least a portion of the liberated steam of atmospheric pressure through a layer of chips to be preheated.

8. An improved process according to claim 6, further including the step of discharging the steam liberated from the defibrated material discharged in the defibrating step under a steam pressure sufficient to force it through a layer of chips to be preheated.

9. In an improved process for manufacturing fiberboard according to the wet method and with a closed backwater system which includes in sequence the steps of: defibrating lignocellulose fiber containing chips within a disintegrating apparatus in a vapor phase of saturated steam of super-atmospheric pressure, suspending the defibrated material discharged from the defibrating step in backwater serving as propellant liquid to form a pulp suspension, forming wet sheets from the pulp suspension, mechanically separating off water from the wet sheets and recycling the water as backwater to form a new pulp suspension and drying the sheets by evaporation of water, the improvement comprising the steps of preheating the chips with steam, then dewatering the heated chips by mechanical compression thereof to a dry content of at least 50 percent, thereafter feeding the thus heated and de-watered chips to the defibrating step and simultaneously supplying backwater separated from the wet sheets to the defibration step for mimimizing overheating of the fiber material and returning at least partially the water removed by the mechanical compression to the process for washing the chips.

10. An improved process as claimed in claim 9, wherein the backwater supplied to the defibrating step is preheated to a temperature between 100° and 170° C.

11. An improved process according to claim 9, in which the water removed by mechanical compression is also used as spray water in the wet forming step.

* * * * *